US007309241B2

(12) United States Patent
Ho

(10) Patent No.: US 7,309,241 B2
(45) Date of Patent: Dec. 18, 2007

(54) PICK AND PLACE ELECTRICAL CONNECTOR

(75) Inventor: Yi-Tse Ho, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/390,175

(22) Filed: Mar. 27, 2006

(65) Prior Publication Data

US 2006/0223382 A1 Oct. 5, 2006

(30) Foreign Application Priority Data

Apr. 1, 2005 (TW) ..... 94205095 U

(51) Int. Cl.
*H01R 12/00* (2006.01)

(52) U.S. Cl. ..... 439/79

(58) Field of Classification Search ..... 439/79, 439/80, 367, 940

See application file for complete search history.

(56) References Cited

U.S. PATENT DOCUMENTS 3,493,916 A * 2/1970 Hansen ..... 439/79
5,676,554 A * 10/1997 Tsuji ..... 439/79
6,161,283 A * 12/2000 Tokuwa ..... 29/882

* cited by examiner

*Primary Examiner*—Phuong Dinh
(74) *Attorney, Agent, or Firm*—Larry I. Golden; Charles S. Cohen

(57) ABSTRACT

An electrical connector is provided for mounting on a circuit board. The connector includes an insulative upright body having a front mating face and a rear terminating face. An engaging plate extends from the mating face of the body in a forward mating direction away from the body. An extension plate extends from the terminating face of the body in a rearward direction away from an upper distal end of the body. A plurality of terminal-receiving passages extend through the body between the front and rear faces thereof. The body is relatively thin in a front-to-rear direction. An upper surface of the distal end of the body and an upper surface of the extension plate are coplanar to define a relatively large suction surface. A plurality of terminals extend through the passages, and each terminal includes a contact portion projecting forwardly for mating with an appropriate terminal of a complementary mating connector, along with a terminating portion projecting from the rear face of the body for connection to an appropriate circuit trace on the printed circuit board.

7 Claims, 3 Drawing Sheets

PICK AND PLACE ELECTRICAL CONNECTOR

FIELD OF THE INVENTION

This invention generally relates to the art of electrical connectors and, particularly, to a connector for mounting on a circuit board and which has improved vacuum suction pick-up means.

BACKGROUND OF THE INVENTION

Some electrical connectors have plastic housings with through passages for receiving a plurality of pin terminals. The housings are molded, and the pin terminals then are inserted into and/or through the passages. It is very difficult to mold the passages if they are of any significant length. Therefore, the portion of the housing through which the passages extend typically is quite thin.

For instance, FIG. 1 shows an electrical connector assembly, generally designated 6, which includes a plug connector, generally designated 8, for mating with a receptacle connector, generally designated 10. Plug connector 8 includes a molded plastic housing, generally designated 12, which has an upright body portion 12*a*. The housing is molded of plastic material and includes a plurality of through passages 12*b* which extend through body portion 12*a*. A plurality of conductive pin terminals, generally designated 14, are inserted through passages 12*b*. The pin terminals have contact portions 14*a* which project forwardly of body portion 12*a* for insertion into a plurality of sockets 16 in receptacle connector 10 for engaging appropriate contacts or terminals (not shown) within the sockets. Terminals 14 are right-angled or L-shaped and include tail portions 14*b* bent downwardly behind body portion 12*a* for insertion into appropriate holes in a printed circuit board and for connection, as by soldering, to appropriate circuit traces on the board and/or in the holes. It can be seen that body portion 12*a* of housing 12 of plug connector 8 is quite thin as shown by the very narrow top surface 18 of the body portion. This makes it easy to mold passages 12*b* through the body portion.

Electrical connectors, such as plug connector 8, often are handled and manipulated during manufacturing processes by automated apparatus, such as during positioning the connector onto a printed circuit board. Typical automated manufacturing processes use vacuum pick-up units which require a sufficient planar or flat surface for the application thereto of a vacuum suction head. Unfortunately, while the very thin body portion 12*a* makes it easy to mold through passages 12*b*, the very narrow top surface 18 of the body portion does not provide a sufficient planar area for the application of a vacuum suction head. In addition, it can be seen that there is little or no protection for the tail portions 14*b* of terminals 14 at the rear or terminating side of the connector where the tail portions are exposed. The present invention is directed to solving these problems by providing a housing structure (a) which is thin enough to easily mold terminal-receiving passages therethrough, (b) which includes an enlarged planar surface for the application thereto of a vacuum suction head and (c) which provides protection for the tail portions of the terminals, the housing structure including components which perform dual functions.

SUMMARY OF THE INVENTION

An object, therefore, of the invention is to provide a new and improved electrical connector of the character described.

In the exemplary embodiment of the invention, an electrical connector is provided for mounting on a circuit board. The connector includes an insulative upright body having a front mating face and a rear terminating face. An engaging plate extends from the mating face of the body in a forward mating direction away from the body. An extension plate extends from the terminating face of the body in a rearward direction away from an upper distal end of the body. A plurality of terminal-receiving passages extend through the body between the front and rear faces thereof. The body is relatively thin in a front-to-rear direction. An upper surface of the distal end of the body and an upper surface of the extension plate are coplanar to define a relatively large vacuum suction surface. A plurality of terminals extend through the passages, and each terminal includes a contact portion projecting forwardly for mating with an appropriate terminal of a complementary mating connector, along with a terminating portion projecting from the rear face of the body for connection to an appropriate circuit trace on the printed circuit board.

According to one aspect of the invention, the terminal-receiving passages in the body are located between the engaging plate and the extension plate. The terminals are generally L-shaped, with the terminating portions being bent downwardly behind the body and beneath the extension plate. Therefore, the extension plate performs a dual function of providing the vacuum suction surface as well as protecting the terminating portions of the terminals which are in position for insertion into appropriate holes in the circuit board.

According to another aspect of the invention, the body includes a plurality of partitions projecting rearwardly from the rear face of the body between the terminal-receiving passages to define grooves aligned with the passages and within which the terminating portions of the terminals are disposed and further protected. In addition, at least some of the terminals have reduced cross-sectional areas for engaging shoulders on the body, generally at the passages, to provide interference means to hold the terminals in the passages.

According to a further aspect of the invention, the terminating portions of at least some of the terminals have tail portions for insertion into appropriate holes in the circuit board. The tail portions are offset to define angled shoulders for engaging edges of the holes. In the preferred embodiment, the tail portions of the at least some terminals are offset in the forward mating direction, and the tail portions of other of the terminals are offset in the rearward direction.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGS. and in which:

DETAILED DESCRIPTION OF THE PREFERRED EMBODIMENT

Figure 1:
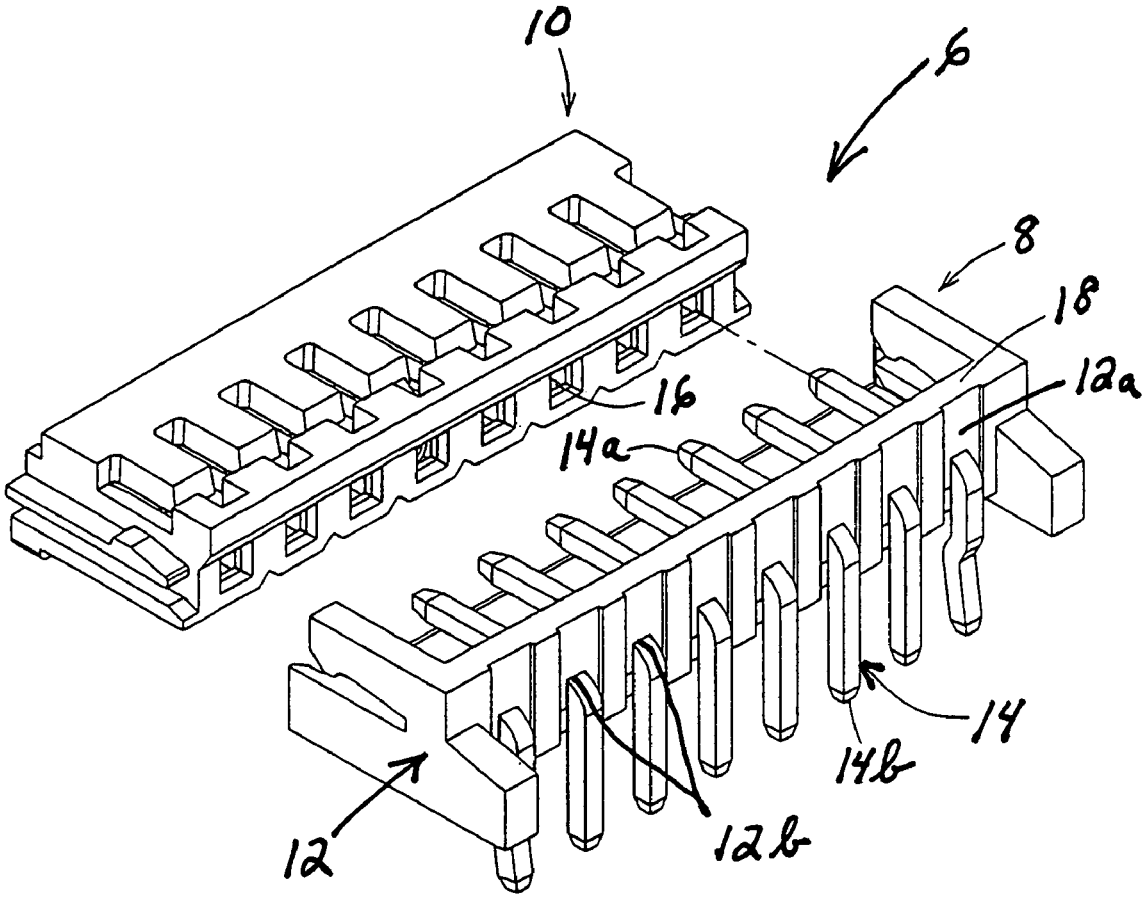
FIG. 1 (PRIOR ART)
FIG. 1 is a perspective view of an electrical connector assembly according to the prior art and as described in the Background, above.

Before proceeding with a detailed description of the invention, it should be understood that such terms as "top", "bottom", "upright", "forward", "rearward", "front", "rear" and the like herein and in the claims hereof are not meant in any way to be limiting in nature. These terms are used only to provide a clear and concise understanding of the invention as depicted in the drawings. The electrical connector assembly herein is omni-directional in use and function.

With those understandings and referring to the drawings in greater detail, the invention is embodied in an electrical connector assembly, generally designated 20, which includes a first or plug connector, generally designated 22, which is mateable with a second or receptacle connector, generally designated 24. The plug connector is mountable on a printed circuit board, generally designated 26, which has a plurality of holes 26*a*. Appropriate circuit traces (not shown) are provided on the circuit board and/or in the holes.

Plug connector 22 includes an insulative upright body 28 which has a front mating face 28*a* and a rear terminating face 28*b*. A plurality of terminal-receiving passages 30 extend through the body between the front and rear faces thereof. The body is relatively thin in a front-to-rear direction. A plurality of partition bosses 32 project rearwardly of the terminating face of the body, between passages 30, to define a plurality of grooves 34 therebetween. The grooves are aligned with the passages and within which terminating portions of the connector terminals are disposed as seen hereinafter.

Figure 2:
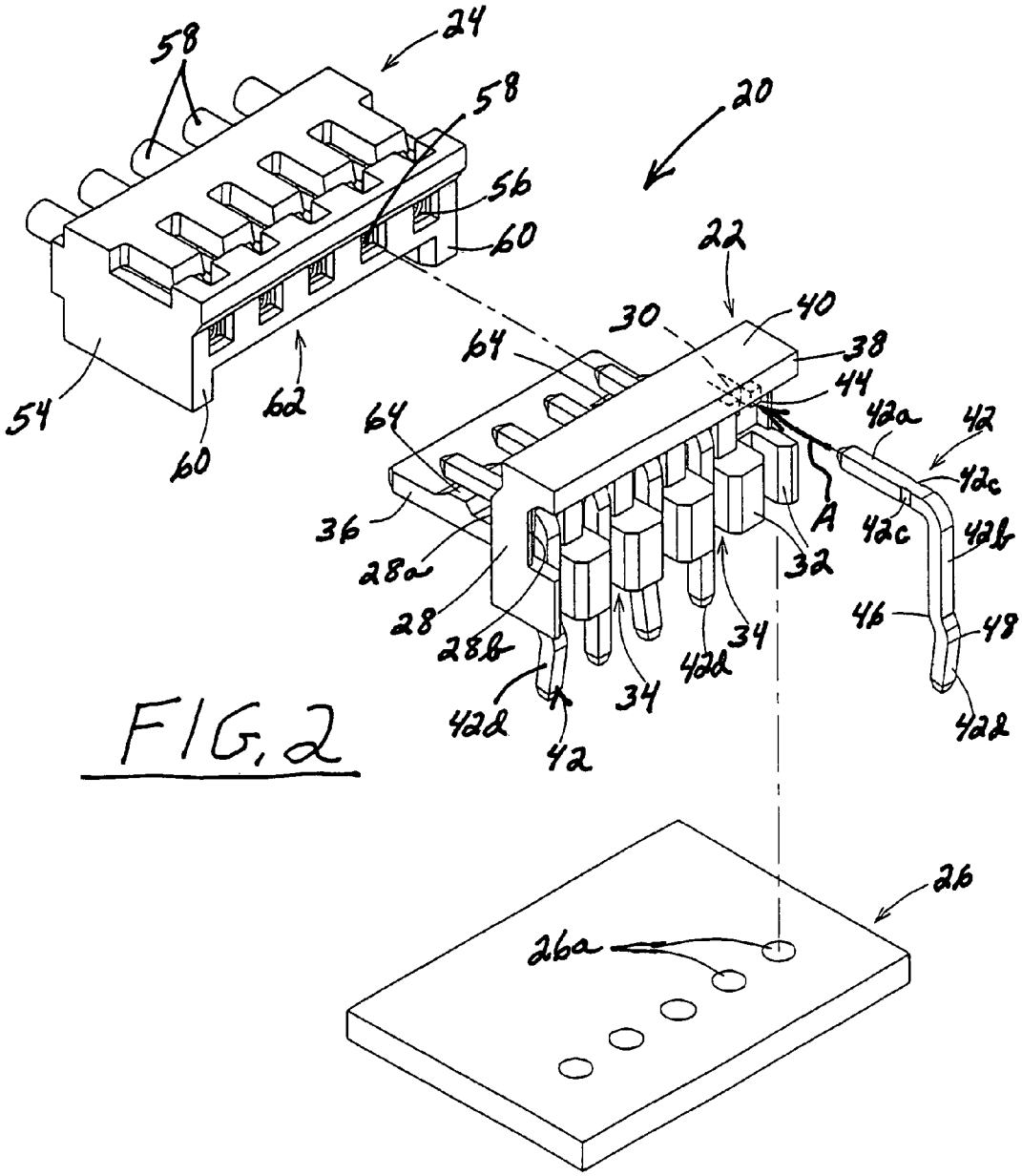
FIG. 2 is a top perspective view of an electrical connector assembly according to the invention, with the connectors unmated, with one of the terminals removed from the plug connector, and in conjunction with a printed circuit board onto which the plug connector is mounted.
Figure 3:
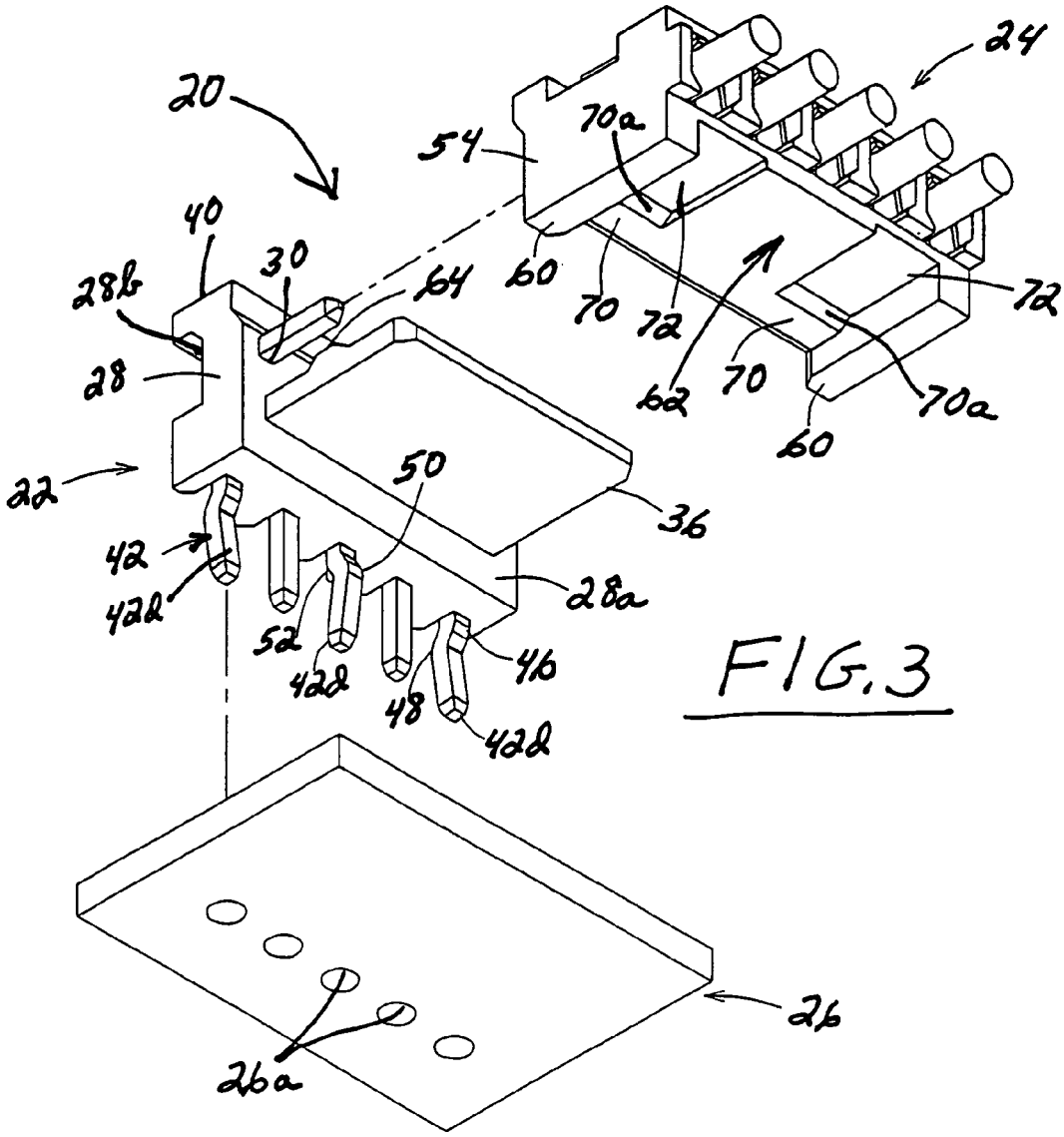
FIG. 3 is a bottom perspective view of the connector assembly of FIG. 1.
Figure 4:
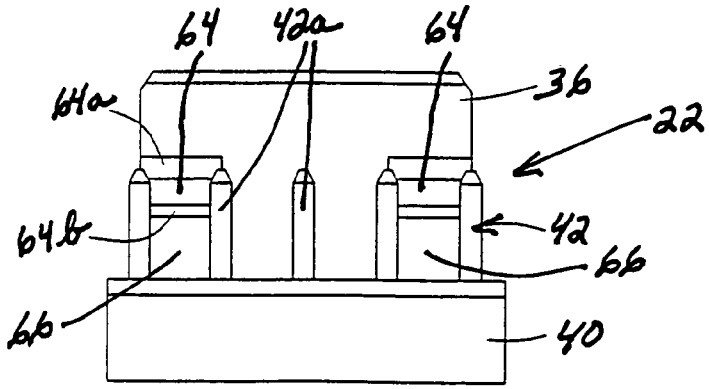
FIG. 4 is a top plan view of the plug connector.

An engaging plate 36 extends from mating face 28*a* of body 28 in a forward mating direction away from the body. An extension plate 38 extends from the rear terminating face 28*b* of the body in a rearward direction away from an upper distal end of the body. The engaging plate and the extension plate are generally flat and are generally parallel to each other as well as parallel to the printed circuit board 26 when plug connector 22 is mounted on the board. An upper surface of the distal end of body 28 and an upper surface of extension plate 38 are coplanar to define a relatively large vacuum suction surface 40 as seen in FIGS. 2 and 4. The suction surface is significantly larger than the front-to-rear thickness of body 28 as can be seen in FIG. 3. Therefore, the body can be molded quite thin to easily mold the terminal-receiving passages 30 therethrough, while still providing a relatively large vacuum suction surface 40 at the top of the body. Terminating portions 42*b* of the terminals are completely protected at the top by extension plate 38, and along their sides by partition bosses 32. Body 28 of plug connector 22, including engaging plate 36, extension plate 38 and partition bosses 32, preferably is a one-piece structure unitarily molded of dielectric material such as plastic or the like.

A plurality of conductive pin-type terminals, generally designated 42, are mounted in body 28 of plug connector 22. As seen best by the one removed terminal 42 in FIG. 2, each terminal is bent in an L-shaped configuration to define a forwardly projecting, pin-like contact portion 42*a* and a downwardly extending terminating portion 42*b*. The terminals are mounted into plug connector 22 by inserting contact portions 42*a* into and through passages 30 in body 28, in the direction of arrow "A" shown in FIG. 2. Each terminal is held within the body by means of a reduced cross-sectional area 42*c* which engages shoulders 44 (FIG. 2) on the body, generally at passages 30, to provide interference means to hold the terminals in the passages. The terminating portions of the terminals have tail portions 42*d* for insertion into holes 26*a* of circuit board 26 and for connection, as by soldering, to appropriate circuit traces on the board and/or in the holes. The tail portions 42*d* are formed relative to the respective terminating portions 42*b* of at least some of the terminals 42, so that plug connector 22 is maintained in a stable, substantially immovable condition on circuit board 26 during a soldering process of connecting the tail portions to the circuit traces on the printed circuit board.

Specifically, referring to FIGS. 2 and 3, tail portions 42*d* of the two end-most terminals 42 are offset rearwardly of the respective terminating portions of those end-most terminals. This creates front angled surfaces 46 and rear angled surfaces 48 which engage the edges of the respective holes 26*a* in the circuit board. As seen in FIG. 3, tail portion 42*d* of the center-most terminal is offset forwardly relative to the terminating portion of the respective terminal to define a front angled surface 50 and a rear angled surface 52 which, again, engage the edges of the center-most hole 26*a* in the circuit board. These oppositely offset tail portions (i.e., the center-most tail portion being offset in a direction opposite the end-most tail portions) create opposing forces when all of the tail portions are inserted into holes 26*a* and, thereby, maintain plug connector 22 in a stable upright condition while the tail portions are soldered to the circuit board.

The second or receptacle connector 24 includes an insulative housing 54 having a plurality of sockets 56 for receiving the pin-like contact portions 42*a* of terminals 42 of plug connector 22. A plurality of conductive female contacts or terminals 58 are disposed within the sockets for receiving and electrically connecting to the contact portions 42*a*. Contacts 58 can be connected to appropriate electrical wires or other conductors (not shown). Housing 54 of receptacle connector 24 is a one piece structure unitarily molded of dielectric material such as plastic or the like. The housing includes a pair of side guide walls 60 depending from the bottom thereof to define a channel, generally designated 62, (FIG. 2) for receiving and guiding engaging plate 36 of plug connector 22 between the side guide walls 60 at the bottom of the receptacle connector.

Generally, interengaging latch means are provided to hold plug connector 22 and receptacle connector 24 in mated condition. Specifically, as best seen in FIG. 4, a pair of transversely spaced, first retaining protrusions 64 project upwardly from the top of engaging plate 36 of plug connector 22. In other words, protrusions 64 project transversely (i.e., upwardly) of the mating direction of the connectors. The protrusions define retaining grooves 66 therebehind, i.e., between the protrusions and body 28. The protrusions have front chamfered edges 64*a* and rear chamfered edges 64*b*. As seen in FIG. 3, the bottom of housing 54 of receptacle connector 24 includes a pair of laterally spaced, second retaining protrusions 70 which define retaining grooves 72 therebehind. Retaining protrusions 70 have chamfered edges 70*a*.

When the plug and receptacle connectors 22 and 24, respectively, are mated, two things occur. First, the pin-like contact portions 42*a* of terminals 42 of the plug connector are inserted into sockets 56 of receptacle connector 24 and into engagement with contacts 58 of the receptacle connector. Second, the first retaining protrusions 64 on the plug connector and the second retaining protrusions 70 on the receptacle connector ride over each other due to the chamfered edges of the protrusions, until protrusions 64 on the plug connector snap into retaining grooves 72 on the receptacle connector, while protrusions 70 on the receptacle connector simultaneously snap into retaining grooves 66 on the plug connector. Since the interengagement of the terminals or contacts between the two connectors prevent the connectors from moving transversely of the mating direction, the respective retaining protrusions on the two connectors cannot inadvertently pull out of the retaining grooves of the other connector. On the other hand, because of the chamfered edges of the retaining protrusions of the respective connectors, the connectors can be unmated by riding the protrusions back over each other while separating the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mounting on a circuit board, comprising:

an insulative upright body having a front mating face and a rear terminating face, an engaging plate extending from the mating face of the body in a forward mating direction away from the body, an extension plate extending from the terminating face of the body in a rearward direction away from an upper distal end of the body, a plurality of terminal-receiving passages extending through the body between the front and rear faces thereof, the body being relatively thin in a front-to-rear direction, and an upper surface of the distal end of the body and an upper surface of the extension plate being coplanar to define a relatively large vacuum suction surface, said body includes a plurality of partitions projecting rearwardly from the rear face of the body between the terminal-receiving passages to define grooves aligned with the passages; and a plurality of generally L-shaped terminals extending through the terminal-receiving passages in the body, the terminals having contact portions projecting forwardly for mating with appropriate terminals of a complementary mating connector, and the terminals having terminating portions projecting from the rear face of the body and being bent downwardly behind the body and beneath the extension plate within said grooves for connection to appropriate circuit traces on the circuit board, said partitions extending rearwardly beyond said terminals positioned respectively in the grooves therebetween.

2. The electrical connector of claim 1 wherein said terminal-receiving passages in the body are located between the engaging plate and the extension plate.

3. The electrical connector of claim 2 wherein the terminating portions of said terminals have tail portions for insertion into appropriate holes in the circuit board.

4. The electrical connector of claim 2 wherein the contact portions of said terminals project forwardly within a vertical profile of the engaging plate.

5. The electrical connector of claim 1 wherein at least some of said terminals have reduced cross-sectional areas for engaging shoulders on the body at said passages to provide interference means to hold the terminals in the passages.

6. The electrical connector of claim 1 wherein the terminating portions of at least some of said terminals have tail portions for insertion into appropriate holes in the circuit board, the tail portions being offset from the terminating portions to define angled shoulders for engaging edges of the holes.

7. The electrical connector of claim 6 wherein the tail portions of said at least some of the terminals are offset in said forward mating direction, and tail portions of other of the terminals are offset in said rearward direction.

* * * * *